US011429063B2

(12) United States Patent
Mitsui

(10) Patent No.: US 11,429,063 B2
(45) Date of Patent: Aug. 30, 2022

(54) IMAGE FORMING APPARATUS INCLUDING AN INTAKE TO INTRODUCE AIR FROM OUTSIDE TO INSIDE THE IMAGE FORMING APPARATUS WHEN A PROCESS CARTRIDGE IS MOUNTED

(71) Applicant: CANON KABUSHIKI KAISHA, Tokyo (JP)

(72) Inventor: Yuji Mitsui, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/361,088

(22) Filed: Jun. 28, 2021

(65) Prior Publication Data

US 2022/0004146 A1 Jan. 6, 2022

(30) Foreign Application Priority Data

Jul. 1, 2020 (JP) ..... JP2020-113769

(51) Int. Cl.
*G03G 21/00* (2006.01)
*G03G 21/20* (2006.01)
*G03G 21/18* (2006.01)

(52) U.S. Cl.
CPC ..... *G03G 21/206* (2013.01); *G03G 21/1842* (2013.01); *G03G 2221/1645* (2013.01); *G03G 2221/183* (2013.01)

(58) Field of Classification Search
CPC ..... G03G 21/206; G03G 21/1676; G03G 21/1842; G03G 2215/0636; G03G 2221/1645; G03G 2221/183
USPC ..... 399/92, 111, 119, 223
See application file for complete search history.

(56) References Cited

U.S. PATENT DOCUMENTS 6,141,512 A * 10/2000 Nagano ..... G03G 21/1814 399/92
9,229,428 B2 * 1/2016 Maeda ..... G03G 21/1842
9,329,570 B1 * 5/2016 Mizutani ..... G03G 21/20
2009/0041498 A1 * 2/2009 Numagami ..... G03G 21/1853 399/111
2012/0148295 A1 * 6/2012 Numagami ..... G03G 15/0194 399/110

FOREIGN PATENT DOCUMENTS

JP 2007086539 A 4/2007
JP 2014137550 A 7/2014
JP 2017219580 A 12/2017

* cited by examiner

*Primary Examiner* — Robert B Beatty
(74) *Attorney, Agent, or Firm* — Canon U.S.A., Inc. I.P. Division

(57) ABSTRACT

When a process cartridge is mounted, air introduced to inside an image forming apparatus via an intake unit flows in a space surrounded by a housing of the process cartridge, a contact unit, and an arm unit, and is exhausted via an exhaust unit. When another process cartridge having a housing larger in size than a housing of the process cartridge is mounted, the air introduced to inside the image forming apparatus via the intake unit flows in a space surrounded by the housing of the another process cartridge having the larger housing, a contact unit, and the arm unit, and is exhausted via the exhaust unit.

7 Claims, 13 Drawing Sheets

IMAGE FORMING APPARATUS INCLUDING AN INTAKE TO INTRODUCE AIR FROM OUTSIDE TO INSIDE THE IMAGE FORMING APPARATUS WHEN A PROCESS CARTRIDGE IS MOUNTED

BACKGROUND

Field of the Disclosure

The present disclosure generally relates to an image forming apparatus, such as an electrophotographic copying machine and an electrophotographic printer (for example, a laser beam printer, a light-emitting diode (LED) printer, etc.

Description of the Related Art

For electrophotographic image forming apparatuses, there is widely known a configuration equipped with a photosensitive member and a development device for supplying toner to the photosensitive member, and including a process cartridge detachably mountable on the image forming apparatus. The process cartridge generates heat in reaction to an electric power supply at the time of image formation. If the process cartridge generates heat and the temperature thereof increases, toner stored in the process cartridge may be melted, which can cause an occurrence of a toner clog and can adversely affect image quality.

To address such an issue, Japanese Patent Application Laid-Open No. 2007-86539 discusses the following configuration as a configuration for reducing or suppressing a temperature increase due to heat generation in a process cartridge in an image forming apparatus in which a plurality of process cartridges is mounted on a plurality of mounting units, respectively. According to the configuration discussed in Japanese Patent Application Laid-Open No. 2007-86539, an air path formation member is provided to each of the process cartridges that form a flow path between the process cartridges adjacent to each other to flow air introduced from outside to inside the image forming apparatus. The air introduced from outside to inside the image forming apparatus flows between the process cartridges adjacent to each other via the air path formation member, whereby the process cartridges are air-cooled and the temperature increase is reduced or suppressed. For electrophotographic image forming apparatuses, there is known a configuration that allows process cartridges in a plurality of sizes to be selectively mounted therein. As will be used herein, the term "process cartridges in a plurality of sizes" refers to, for example, a normal process cartridge and a large-capacity process cartridge having a larger housing than the normal process cartridge and storing a larger amount of toner than the normal process cartridge.

The above-described temperature increase due to the heat generation in the process cartridge should also be reduced or suppressed in such an image forming apparatus configured to allow the process cartridges in the plurality of sizes to be selectively mounted therein. While, according to the configuration discussed in Japanese Patent Application Laid-Open No. 2007-86539, the plurality of process cartridges can be efficiently cooled using the air path formation member, each of the selectively mounted process cartridges in the plurality of sizes may not be efficiently cooled.

SUMMARY

Aspects of the present disclosure include providing an image forming apparatus configured to allow process cartridges in a plurality of sizes to be selectively mounted therein and capable of efficiently cooling the process cartridges.

According to an aspect of the present disclosure, an image forming apparatus configured to allow a first process cartridge and a second process cartridge to be selectively mounted therein, the first process cartridge including a first photosensitive member and a first development unit configured to supply a developer to the first photosensitive member, the second process cartridge including a second photosensitive member and a second development unit configured to supply a developer to the second photosensitive member, the second process cartridge having a housing larger in size than a housing of the first process cartridge, the image forming apparatus includes a first contact member configured to come into contact with the housing of the first process cartridge when the first process cartridge is mounted, a second contact member configured to come into contact with the housing of the second process cartridge when the second process cartridge is mounted, a support member supporting the first contact member and the second contact member, an intake unit configured to introduce air from outside to inside the image forming apparatus, and an exhaust unit configured to exhaust the air introduced to inside the image forming apparatus via the intake unit to outside the image forming apparatus, wherein, when the first process cartridge is mounted, the air introduced to inside the image forming apparatus via the intake unit flows in a space surrounded by the housing of the first process cartridge, the first contact member, and the support member, and is exhausted via the exhaust unit, and wherein, when the second process cartridge is mounted, the air introduced to inside the image forming apparatus via the intake unit flows in a space surrounded by the housing of the second process cartridge, the second contact member, and the support member, and is exhausted via the exhaust unit.

Further features of the present disclosure will become apparent from the following description of exemplary embodiments with reference to the attached drawings.

DESCRIPTION OF THE EMBODIMENTS

<Image Forming Apparatus>

In the following description, first, an overall configuration of an image forming apparatus according to a first exemplary embodiment of the present disclosure will be described together with an operation of the image forming apparatus at the time of image formation with reference to the drawings. The dimensions, the materials, the shapes, the relative layout, and the like of components that will be described below are not intended to limit the scope of the present disclosure only thereto unless otherwise specifically described.

Figure 1:
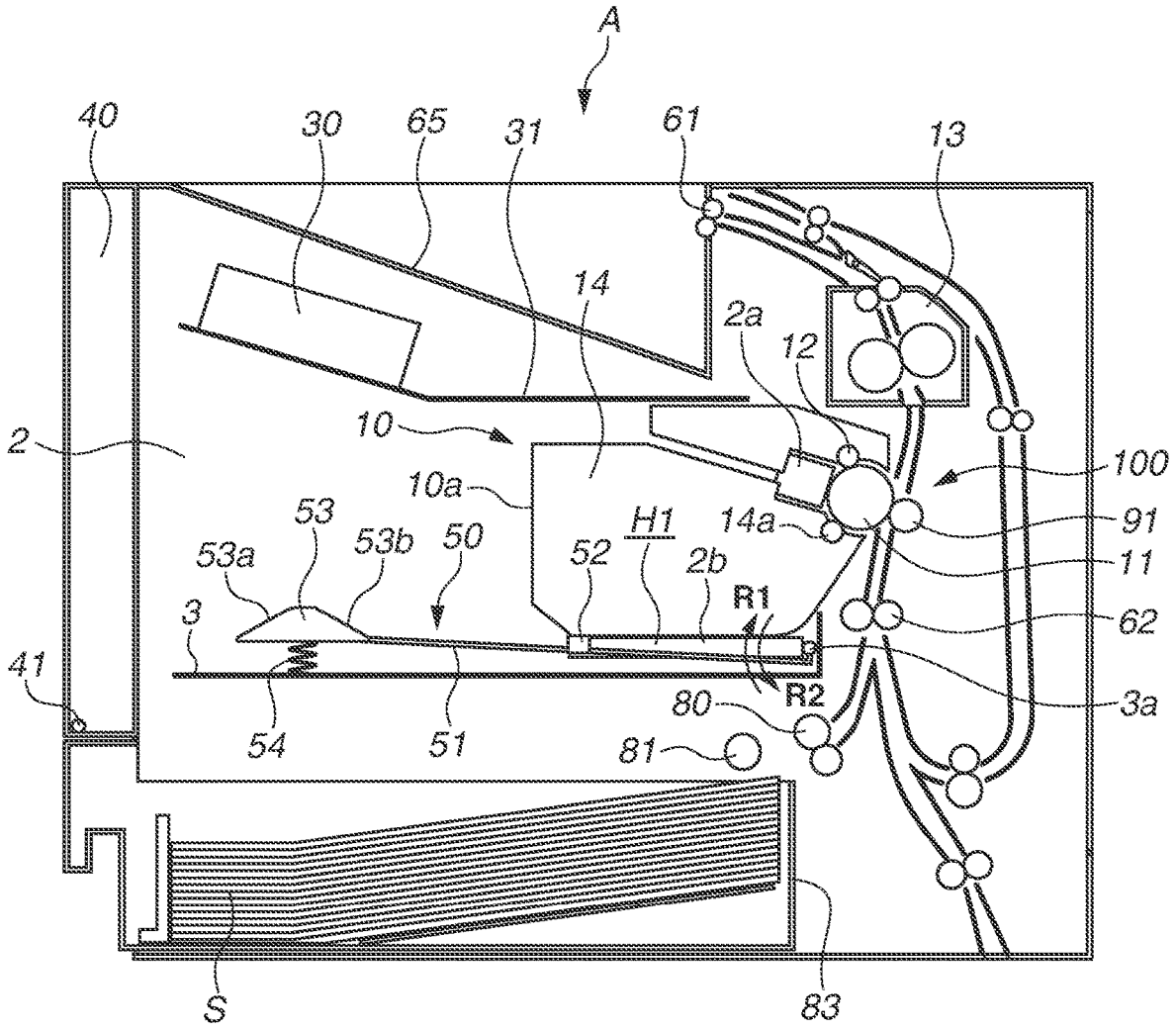
FIG. 1 is a schematic cross-sectional diagram illustrating an image forming apparatus.
Figure 2:
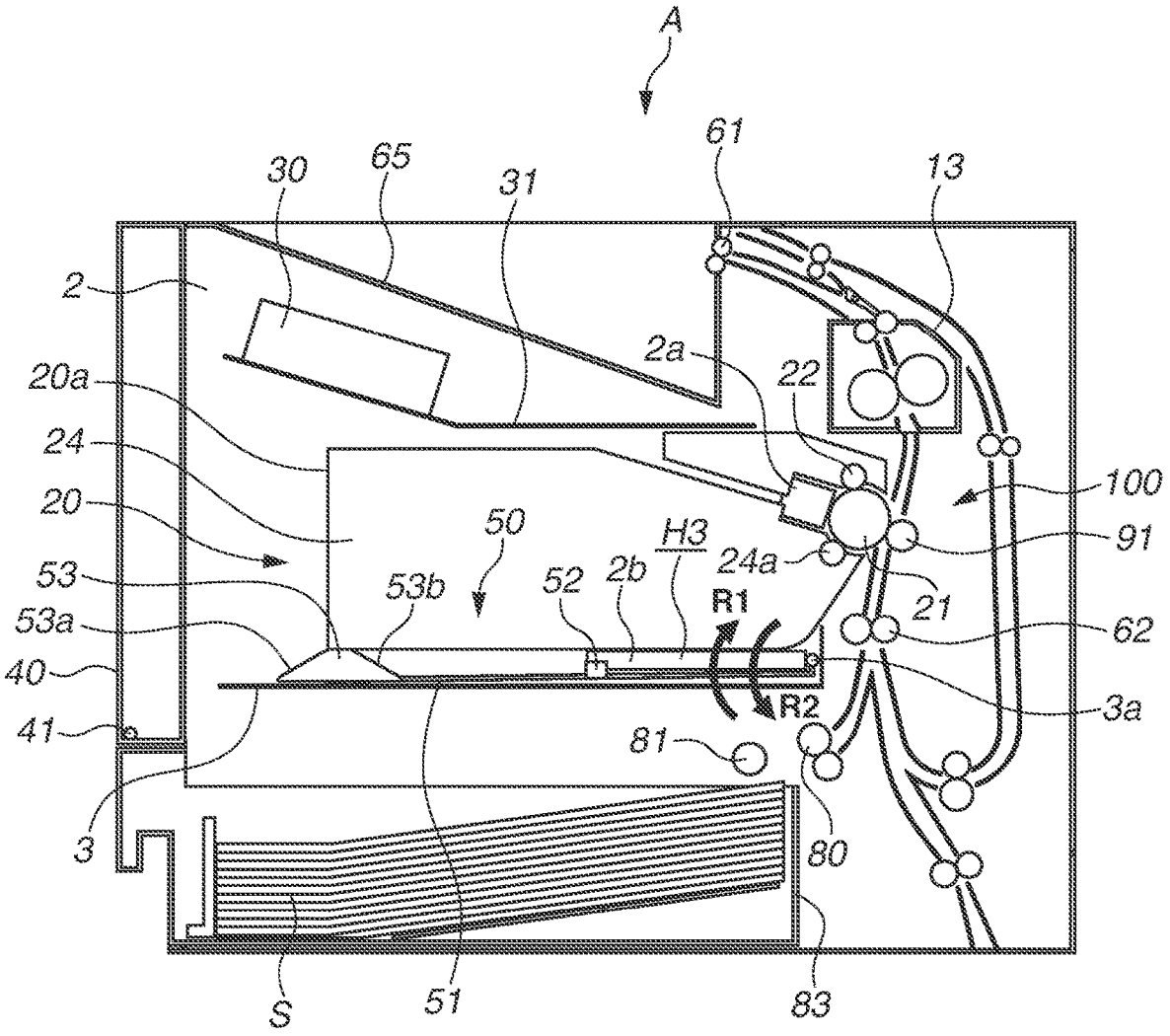
FIG. 2 is a schematic cross-sectional diagram illustrating the image forming apparatus.

FIGS. 1 and 2 are schematic cross-sectional diagrams illustrating an image forming apparatus A. In the present exemplary embodiment, the image forming apparatus A is configured to allow a process cartridge 10 (a first process cartridge) and a process cartridge 20 (a second process cartridge) having housings in different sizes from each other to be selectively detachably mounted on a mounting unit (not illustrated) of the image forming apparatus A. This can also be said that an image forming system includes the image forming apparatus A and the process cartridges 10 and 20. FIG. 1 illustrates the image forming apparatus A with the process cartridge 10 mounted therein. FIG. 2 illustrates the image forming apparatus A with the process cartridge 20 mounted therein.

As illustrated in FIGS. 1 and 2, the image forming apparatus A includes an image forming unit 100, which forms a toner image using toner serving as a developer on a sheet S. The image forming unit 100 includes a transfer roller 91, a laser scanner unit 30, and the process cartridge 10 or the process cartridge 20.

The process cartridge 10 includes a photosensitive drum 11 (a first photosensitive member), a charging roller 12, and a development device 14 (a first development unit) including a development roller 14*a*. The process cartridge 20 includes a photosensitive drum 21 (a second photosensitive member), a charging roller 22, and a development device 24 (a second development unit) including a development roller 24*a*. The process cartridge 20 is a large-capacity process cartridge having a housing 20*a* larger than a housing 10*a* of the process cartridge 10 and storing a larger amount of toner inside the housing 20*a*, and is configured similarly to the process cartridge 10 expect for the foregoing. The image forming apparatus A performs an image forming operation, which will be described below, with the process cartridge 10 or the process cartridge 20 mounted on the mounting unit (not illustrated).

Further, the image forming apparatus A includes a front cover 40. The front cover 40 is pivotally supported at a support unit 41, and pivotally moves between an opened position and a closed position about the support unit 41. A not-illustrated opening portion leading to the inside of the image forming apparatus A is formed by the pivotal movement of the front cover 40 from the closed position to the opened position. A user accesses the inside of the image forming apparatus A via the not-illustrated opening portion, and mounts and detaches the process cartridge 10 and the process cartridge 20.

Further, the image forming apparatus A includes a right-side plate (not illustrated), a left-side plate 2, and a central frame 3 and a scanner frame 31 that are fixed to the left-side plate 2, as a frame member. The scanner frame 31 supports the laser scanner unit 30. Through-holes 2*a* and 2*b* are formed on the left-side plate 2. When the process cartridge 10 is mounted in the image forming apparatus A, the through-hole 2*a* is located near the photosensitive drum 11 and the through-hole 2*b* is located near the development device 14. When the process cartridge 20 is mounted in the image forming apparatus A, the through-hole 2*a* is located near the photosensitive drum 21 and the through-hole 2*b* is located near the development device 24. The functions of the through-holes 2*a* and 2*b* will be described below.

The central frame 3 supports a duct unit 50. The duct unit 50 includes an arm unit 51 pivotally supported on a support unit 3*a* of the central frame 3, contact units 52 and 53 supported on the arm unit 51, and a spring 54 fixed to the central frame 3 and the arm unit 51. The central frame 3 and the arm unit 51 (a support member) each include a portion extending in a direction in which the process cartridges 10 and 20 are inserted toward the not-illustrated mounting unit (a direction indicated by an arrow K1 illustrated in FIG. 4).

The contact unit 52 (a first contact member) is made of an elastic body, such as a mold and a rubber material, and contacts the housing 10*a* of the process cartridge 10 mounted on the mounting unit (not illustrated) of the image forming apparatus A. The contact unit 53 (a second contact member) is made of an elastic body, such as a mold and a rubber material, and contacts the housing 20*a* of the process cartridge 20 mounted on the mounting unit (not illustrated) of the image forming apparatus A. The contact unit 53 is disposed on the upstream side with respect to the contact unit 52 in the direction in which the process cartridges 10 and 20 are inserted toward the not-illustrated mounting unit.

The spring 54 (a biasing member) biases the arm unit 51 upward. The biasing force of the spring 54 generates a moment M1 pivotally moving the arm unit 51 about the support unit 3*a* in a direction indicated by an arrow R1. Due to the moment M1, the contact unit 52 is biased against the housing 10*a* of the process cartridge 10 with the process cartridge 10 mounted on the mounting unit (not illustrated). Likewise, the contact unit 53 is biased against the housing 20*a* of the process cartridge 20 with the process cartridge 20 mounted on the mounting unit (not illustrated). The elastic force of the spring 54 is set to such a force that the arm unit 51 supporting the contact units 52 and 53 can be lifted up. The function of the duct unit 50 will be described below.

Next, the image forming operation will be described. The image forming operation will be described now citing an example of a case where the process cartridge 10 is mounted in the image forming apparatus A, but is also performed in a similar manner even in a case where the process cartridge 20 is mounted. First, when an image forming job signal is input to a not-illustrated control unit, the sheet S contained in a sheet cassette 83 is conveyed to a registration roller 62 by a pickup roller 81 and a feeding roller 80. Next, the sheet S is conveyed by the registration roller 62 at a predetermined timing to a transfer nip portion formed by the photosensitive drum 11 and the transfer roller 91.

Meanwhile, at the image forming unit 100, first, the surface of the photosensitive drum 11 being in contact with the charging roller 12 is charged by application of a voltage to the charging roller 12. After that, the laser scanner unit 30 irradiates the surface of the photosensitive drum 11 with laser light according to image data transmitted from a not-illustrated external apparatus. As a result, a potential on the surface of the photosensitive drum 11 is partially reduced and an electrostatic latent image according to the image data is formed on the surface of the photosensitive drum 11.

Next, a toner image is formed by attaching the toner from the development roller 14*a* onto the electrostatic latent image formed on the surface of the photosensitive drum 11 at the development device 14. After that, the toner image on the surface of the photosensitive drum 11 is conveyed to the transfer nip portion by a rotation of the photosensitive drum 11. When the toner image reaches the transfer nip portion, the toner image is transferred onto the sheet S by application of a voltage opposite in polarity from the charged polarity of the toner to the transfer roller 91.

Next, the sheet S with the toner image transferred thereon is conveyed to a fixing device 13. Then, the toner image on the sheet S is subjected to fixing processing of heating and pressing at the fixing device 13, by which the toner image borne on the sheet S is melted and fixed onto the sheet S. After that, the sheet S with the toner image fixed thereon is discharged onto a discharge unit 65 by a discharge roller 61.

<Cooling Configuration>

When electric power is supplied to the process cartridge 10 or 20, the process cartridge 10 or 20 generates heat. If the process cartridge 10 or 20 heats up and the temperature thereof increases due to the heat generation, the toner contained in the process cartridge 10 or 20 may be melted, which cause an occurrence of a toner clog and can adversely affect image quality. Therefore, the image forming apparatus A includes a configuration for cooling the process cartridges 10 and 20. In the following description, the configuration for cooling the process cartridges 10 and 20 will be described.

Figure 3:
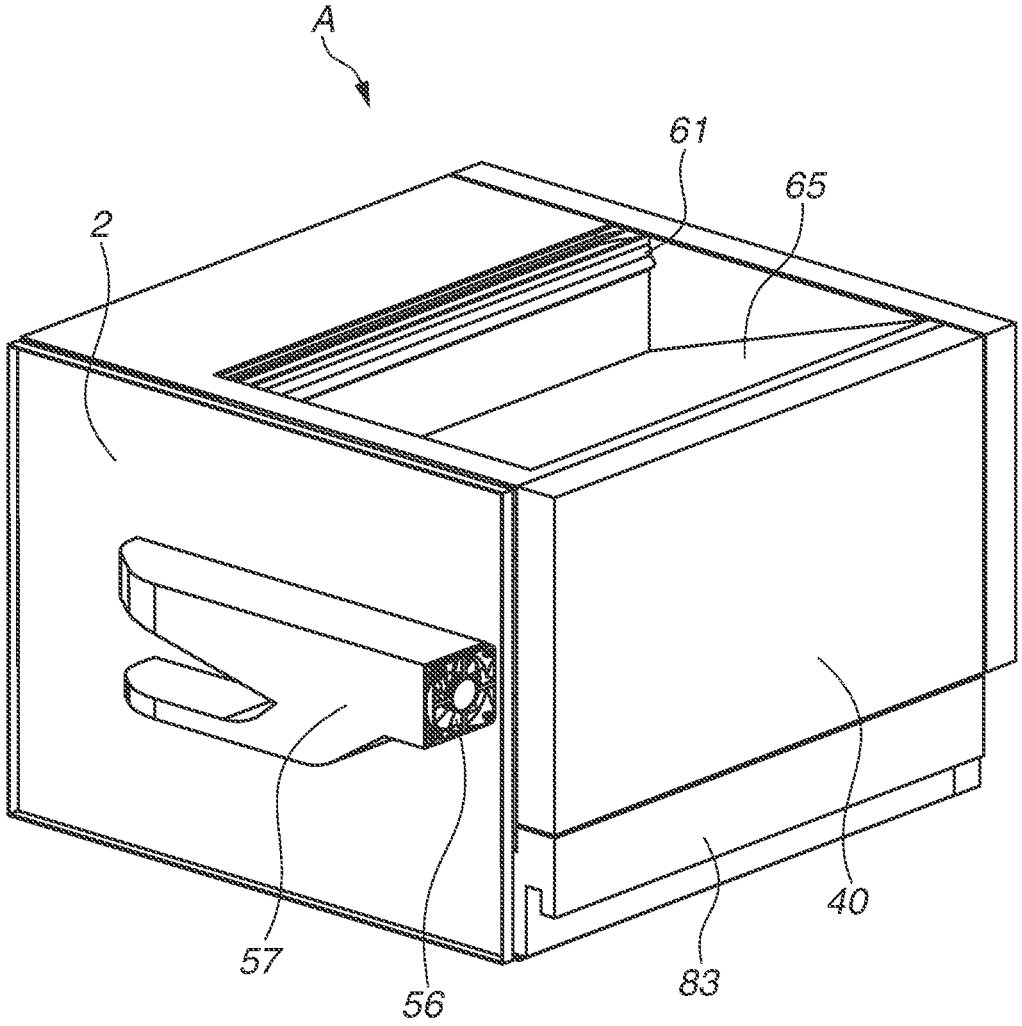
FIG. 3 is a perspective diagram illustrating the image forming apparatus.

FIG. 3 is a perspective diagram illustrating the image forming apparatus A with a left-side surface exterior removed. As illustrated in FIG. 3, a duct 57 is installed on the left-side plate 2 of the image forming apparatus A. The duct 57 is connected to a not-illustrated intake port (an intake unit) formed on the left-side surface exterior (not illustrated), and air outside the image forming apparatus A is introduced into the duct 57 via the intake port. The left-side plate 2 also serves as a part of the side wall of the duct 57. Further, a fan 56, which generates an air current for introducing the external air to inside the duct 57 via the above-described not-illustrated intake port, is provided inside the duct 57. In other words, the fan 56 generates the air current for introducing the air outside the image forming apparatus A to inside the image forming apparatus A.

The fan 56 is controlled by the not-illustrated control unit to rotate (operate) while the image forming operation is performed by the image forming apparatus A, and stop upon the end of the image forming operation. The air introduced from outside the image forming apparatus A into the duct 57 while the fan 56 rotates is moved through inside the duct 57 and supplied to the through-holes 2*a* and 2*b* (FIGS. 1 and 2) formed on the left-side plate 2. After that, the air conveyed through the through-hole 2*a* is supplied to around the photosensitive drum 11 or the photosensitive drum 21 and air-cools the photosensitive drum 11 or the photosensitive drum 21. The air conveyed through the through-hole 2*b* is supplied to around the development device 14 or the development device 24 and air-cools the development device 14 or the development device 24.

The air conveyed through the through-hole 2*b* and supplied to around the development device 14 or 24 passes through a flow path defined by the duct unit 50 to air-cool the process cartridge 10 or 20, and is exhausted to outside the image forming apparatus A. The duct unit 50 defines an air flow path different between when the process cartridge 10 is mounted and when the process cartridge 20 is mounted, to efficiently air-cool each of the process cartridges 10 and 20. In the following description, the air flow path defined by the duct unit 50 will be described.

Figure 4:
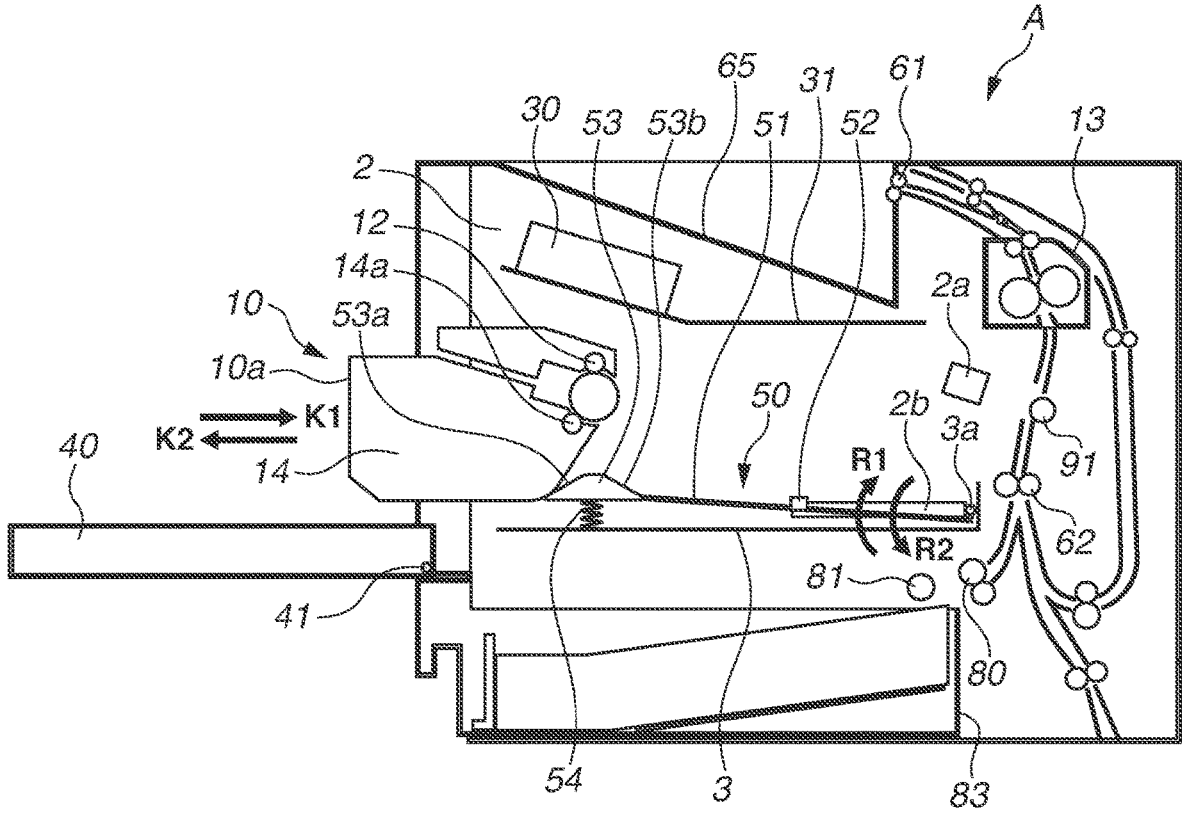
FIG. 4 is a schematic cross-sectional diagram illustrating the image forming apparatus.
Figure 5:
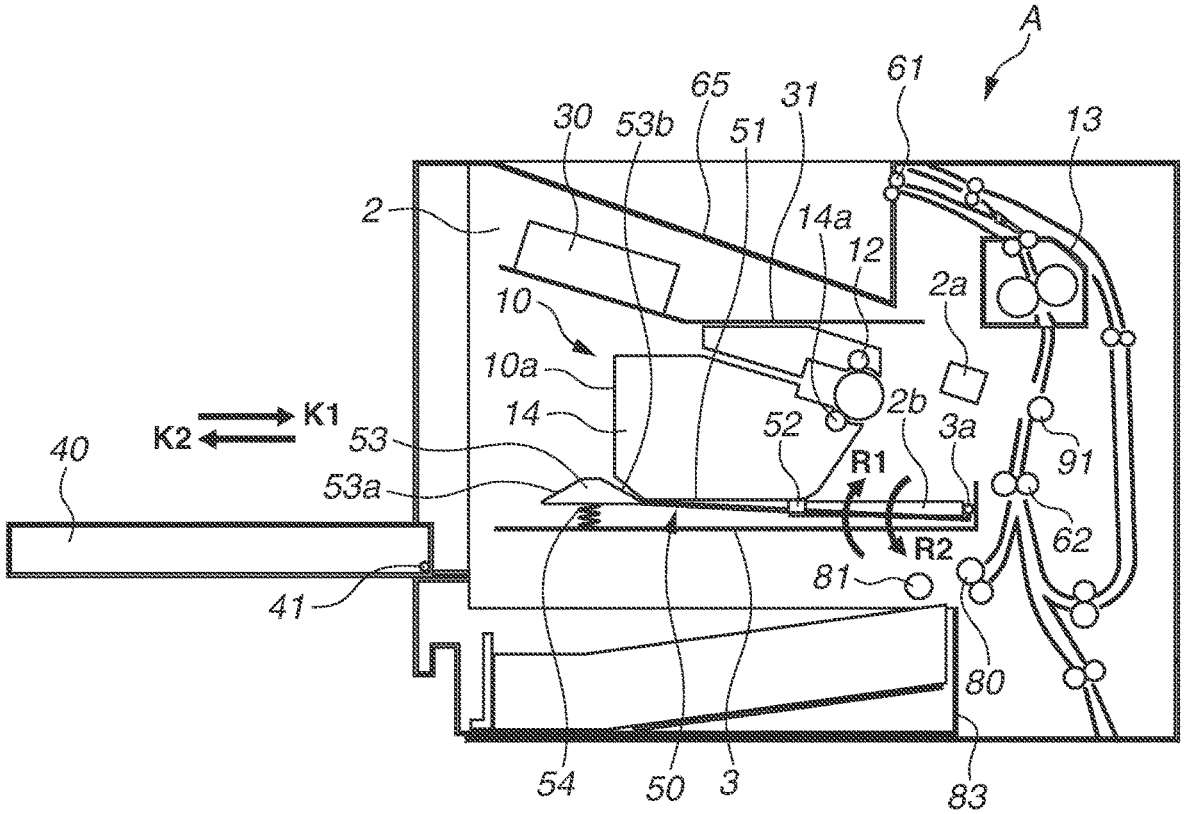
FIG. 5 is a schematic cross-sectional diagram illustrating the image forming apparatus.
Figure 6:
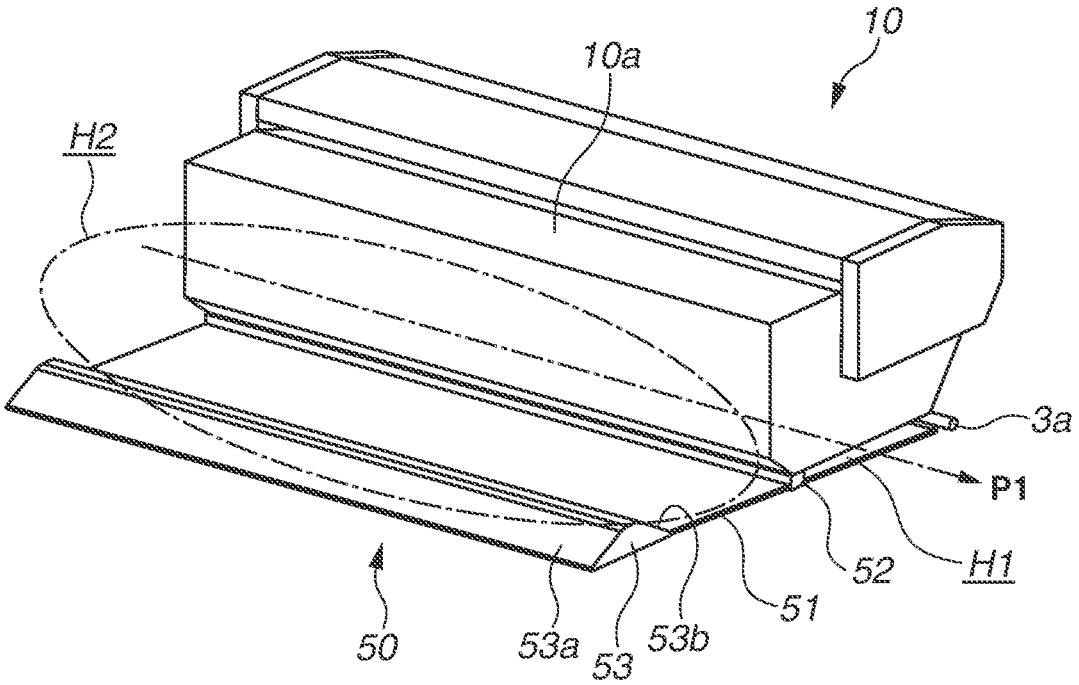
FIG. 6 is a perspective diagram illustrating a process cartridge.

First, a configuration of the duct unit 50 when the process cartridge 10 is mounted will be described. FIGS. 4 and 5 are schematic cross-sectional diagrams of the image forming apparatus A, and illustrate how the process cartridge 10 is being mounted in the order of FIGS. 4 and 5. FIG. 6 is a perspective diagram around the process cartridge 10 with the process cartridge 10 mounted on the not-illustrated mounting unit of the image forming apparatus A.

As illustrated in FIG. 4, when mounting the process cartridge 10 onto the not-illustrated mounting unit, the user inserts the process cartridge 10 into the image forming apparatus A via the not-illustrated opening portion appeared by moving the front cover 40 from the closed position to the opened position. Next, the user moves the process cartridge 10 toward the not-illustrated mounting unit in the direction indicated by the arrow K1 illustrated in FIG. 3 inside the image forming apparatus A.

When the user moves the process cartridge 10 in the direction indicated by the arrow K1, the lower end portion of the housing 10*a* of the process cartridge 10 comes into contact with a cam surface 53*a* of the contact unit 53. In this process, a net force F1 of a force in the direction indicated by the arrow K1, with which the user presses the process cartridge 10, and a vertically downward force due to the weight of the process cartridge 10 itself is applied to the cam surface 53*a*. The net force F1 generates a moment M2 for pivotally moving the arm unit 51 about the support unit 3*a* in a direction indicated by an arrow R2. Then, the user presses the process cartridge 10 in the direction indicated by the arrow K1 until the process cartridge 10 reaches the mounting unit, and thus the magnitude of the moment M2 exceeds the above-described moment M1 generated due to the biasing force of the spring 54. Thus, the moment M2 is applied to the arm unit 51, and the arm unit 51 pivotally moves in the direction indicated by the arrow R2.

Next, as illustrated in FIG. 5, when the user further moves the process cartridge 10 in the direction indicated by the arrow K1 as far as a position above the contact unit 52, the housing 10*a* of the process cartridge 10 is separated from the contact unit 53. The separation of the process cartridge 10 from the contact unit 53 leads to application of only the moment M1 to the arm unit 51 without the moment M2, whereby the arm unit 51 pivotally moves about the support unit 3*a* in the direction indicated by the arrow R1 in reaction to the application of the moment M1. Due to the pivotal movement of the arm unit 51 in this manner, the contact unit 52 comes into contact with the lower end portion of the housing 10*a* of the process cartridge 10.

Next, when the user further moves the process cartridge 10 in the direction indicated by the arrow K1, the process cartridge 10 reaches the not-illustrated mounting unit and is mounted onto the mounting unit, whereby the imaging forming apparatus A is brought into the state illustrated in FIG. 1. After that, the user completes the work of mounting the process cartridge 10 by moving the front cover 40 from the opened position to the closed position.

When the process cartridge 10 is mounted on the not-illustrated mounting unit, the lower end portion of the housing 10*a* of the process cartridge 10 is in contact with the contact unit 52 while neither facing nor being in contact with the contact unit 53. As a result, a space H1, which is surrounded by the lower end portion of the housing 10*a* of the process cartridge 10, the arm unit 51, and the contact unit 52, is formed below the housing 10*a* of the process cartridge 10. As described above, while the image forming operation is performed by the image forming apparatus A, the fan 56 is in operation and the air outside the image forming apparatus A is introduced into the duct 57 with the air current generated by the fan 56. Then, a part of the air introduced into the duct 57 passes through the through-hole 2*b* and is supplied to the space H1 below the process cartridge 10. In other words, the duct 57 guides the air introduced from outside to inside the image forming apparatus A to the space H1.

As illustrated in FIG. 6, the air supplied to the space H1 is blocked by the lower end portion of the housing 10*a* of the process cartridge 10, the arm unit 51, and the contact unit 52, and flows in the space H1 in a direction indicated by an arrow P1, which is the longitudinal direction of the process cartridge 10. More specifically, the air flowing in the space H1 stays in the space H1 without flowing into a space H2 on the front cover 40 side with respect to the process cartridge 10 by being blocked by the contact unit 52. In other words, the lower end portion of the housing 10*a* of the process cartridge 10, the arm unit 51, and the contact unit 52 each function as the wall of the duct to define the air flow path. The process cartridge 10 is air-cooled across the longitudinal direction thereof with the air flowing in the space H1 in this manner. After air-cooling the process cartridge 10, the air passes through a through-hole (not illustrated) formed on the right-side plate (not illustrated), and is exhausted to outside the image forming apparatus A via an exhaust port (not illustrated) formed on a right-side surface exterior of the image forming apparatus A.

When detaching the process cartridge 10 from the image forming apparatus A, the user performs the operation in the reverse order of the above-described operation for mounting the process cartridge 10. More specifically, the user moves the process cartridge 10 mounted on the not-illustrated mounting unit in a direction indicated by an arrow K2 illustrated in FIG. 3 and pulls out the process cartridge 10 from the process cartridge 10 via the not-illustrated opening portion. When the process cartridge 10 is being detached, the lower end portion of the housing 10*a* of the process cartridge 10 comes into contact with a cam surface 53*b* of the contact unit 53, by which the arm unit 51 pivotally moves in the direction indicated by the arrow R2 according to a similar mechanism to the mechanism at the time of when the lower end portion comes into contact with the cam surface 53*a*. After that, when the user moves the process cartridge 10 in the direction indicated by the arrow K2 and thus the process cartridge 10 is separated from the contact unit 53, the arm unit 51 pivotally moves about the support unit 3*a* in the direction indicated by the arrow R1 to return to the original position in reaction to the application of the moment M1.

Figure 7:
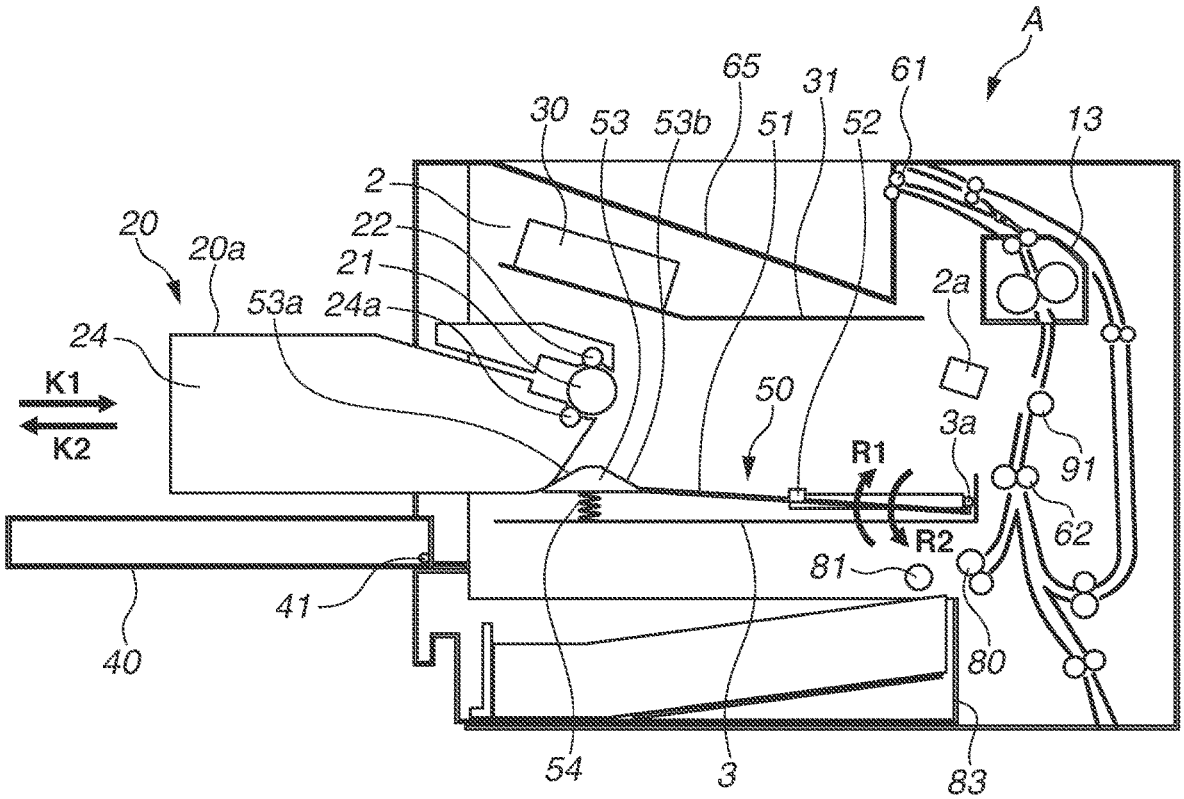
FIG. 7 is a schematic cross-sectional diagram illustrating the image forming apparatus.
Figure 8:
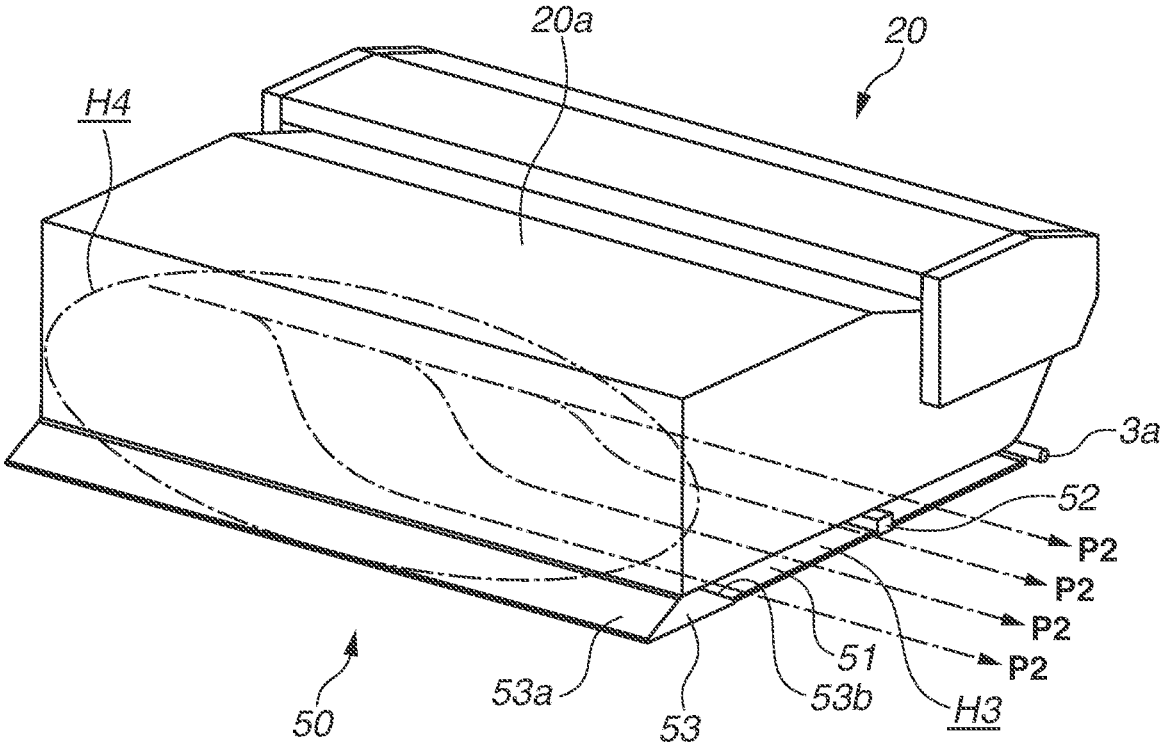
FIG. 8 is a perspective diagram illustrating a process cartridge.

Next, the configuration of the duct unit 50 when the process cartridge 20 is mounted will be described. FIG. 7 is a schematic cross-sectional diagram illustrating the image forming apparatus A, and illustrates the operation when the process cartridge 20 is in the process of being mounted. FIG. 8 is a perspective diagram illustrating the surroundings of the process cartridge 20 mounted on the not-illustrated mounting unit of the image forming apparatus A.

As illustrated in FIG. 7, when mounting the process cartridge 20 onto the not-illustrated mounting unit, the user inserts the process cartridge 20 into the image forming apparatus A via the not-illustrated opening portion appeared by moving the front cover 40 from the closed position to the opened position. Next, the user moves the process cartridge 20 toward the not-illustrated mounting unit in the direction indicated by the arrow K1 illustrated in FIG. 7 inside the image forming apparatus A.

When the user moves the process cartridge 20 in the direction indicated by the arrow K1, the lower end portion of the housing 20*a* of the process cartridge 20 comes into contact with the cam surface 53*a* of the contact unit 53. As a result, the arm unit 51 is subjected to application of a moment for pivotally moving the arm unit 51 about the support unit 3*a* in the direction indicated by the arrow R2 according to a similar mechanism to when the process cartridge 10 is mounted, and the arm unit 51 pivotally moves in the direction indicated by the arrow R2.

Next, when the user further moves the process cartridge 20 in the direction indicated by the arrow K1, the process cartridge 20 reaches the not-illustrated mounting unit and is mounted onto the not-illustrated mounting unit, whereby the imaging forming apparatus A is brought into the state illustrated in FIG. 2. After that, the user completes the work of mounting the process cartridge 20 by moving the front cover 40 from the opened position to the closed position.

Then, when the process cartridge 20 is mounted on the not-illustrated mounting unit, the lower end portion of the housing 20*a* of the process cartridge 20 is in contact with the contact unit 53 without being in contact with the contact unit 52 although facing the contact unit 52. This is because the height of the contact unit 53 is taller than the height of the contact unit 52. As a result, a space H3, which is surrounded by the lower end portion of the housing 20*a* of the process cartridge 20, the arm unit 51, and the contact unit 53, is formed below the housing 20*a* of the process cartridge 20. As described above, while the image forming operation is performed by the image forming apparatus A, the fan 56 is in operation and the air outside the image forming apparatus A is introduced into the duct 57 with the air current generated by the fan 56. Then, a part of the air introduced into the duct 57 passes through the through-hole 2*b* and is supplied to the space H3 below the process cartridge 20. In other words, the duct 57 guides the air introduced from outside to inside the image forming apparatus A to the space H3.

As illustrated in FIG. 8, the air supplied to the space H3 is blocked by the lower end portion of the housing 20*a* of the process cartridge 20, the arm unit 51, and the contact unit 53, and flows in the space H3 in a direction indicated by an arrow P2, which is the longitudinal direction of the process cartridge 20. More specifically, the air flowing in the space H3 stays in the space H3 without flowing into a space H4 on the front cover 40 side with respect to the process cartridge 20 by being blocked by the contact unit 53. In other words, the lower end portion of the housing 20*a* of the process cartridge 20, the arm unit 51, and the contact unit 53 each function as the wall of the duct to define the air flow path. The process cartridge 20 is air-cooled across the longitudinal direction thereof with the air flowing in the space H3 in this manner. After air-cooling the process cartridge 20, the air passes through the through-hole (not illustrated) formed on the right-side plate (not illustrated), and is exhausted to outside the image forming apparatus A via the not-illustrated exhaust port (an exhaust unit) formed on the right-side surface exterior of the image forming apparatus A.

In the above-described manner, in the image forming apparatus A according to the present exemplary embodiment, the air flow path for air-cooling the process cartridge 10 is defined using the lower end portion of the housing 10*a* of the process cartridge 10, and the arm unit 51 and the contact unit 52 of the duct unit 50. The air flow path for air-cooling the process cartridge 20 is defined using the lower end portion of the housing 20*a* of the process cartridge 20, and the arm unit 51 and the contact unit 53 of the duct unit 50. Due to such a configuration, the image forming apparatus A, which is configured to allow the process cartridges 10 and 20 in the plurality of sizes to be selectively mounted therein, can efficiently cool the process cartridges 10 and 20. Therefore, the image forming apparatus A can reduce or suppress the increases in the temperatures of the process cartridges 10 and 20, whereby the toner contained in the process cartridges 10 and 20 can be prevented from being melted.

Next, a second exemplary embodiment of the image forming apparatus according to the present disclosure will be described with reference to the drawings. The second exemplary embodiment will be described, assigning the same reference numerals and omitting the redundant descriptions with respect to portions whose descriptions overlap the first exemplary embodiment.

Figure 9:
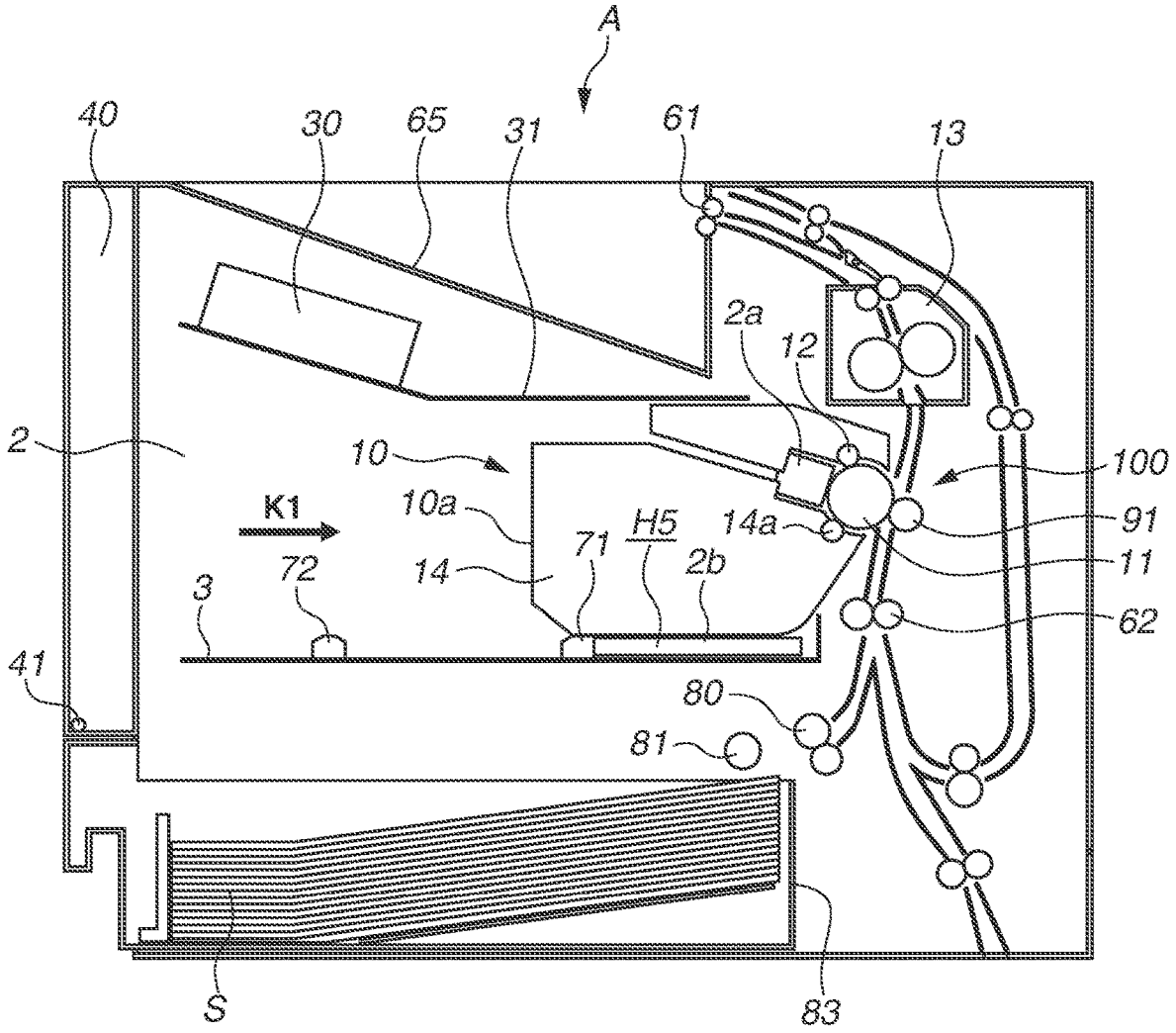
FIG. 9 is a schematic cross-sectional diagram illustrating the image forming apparatus.
Figure 10:
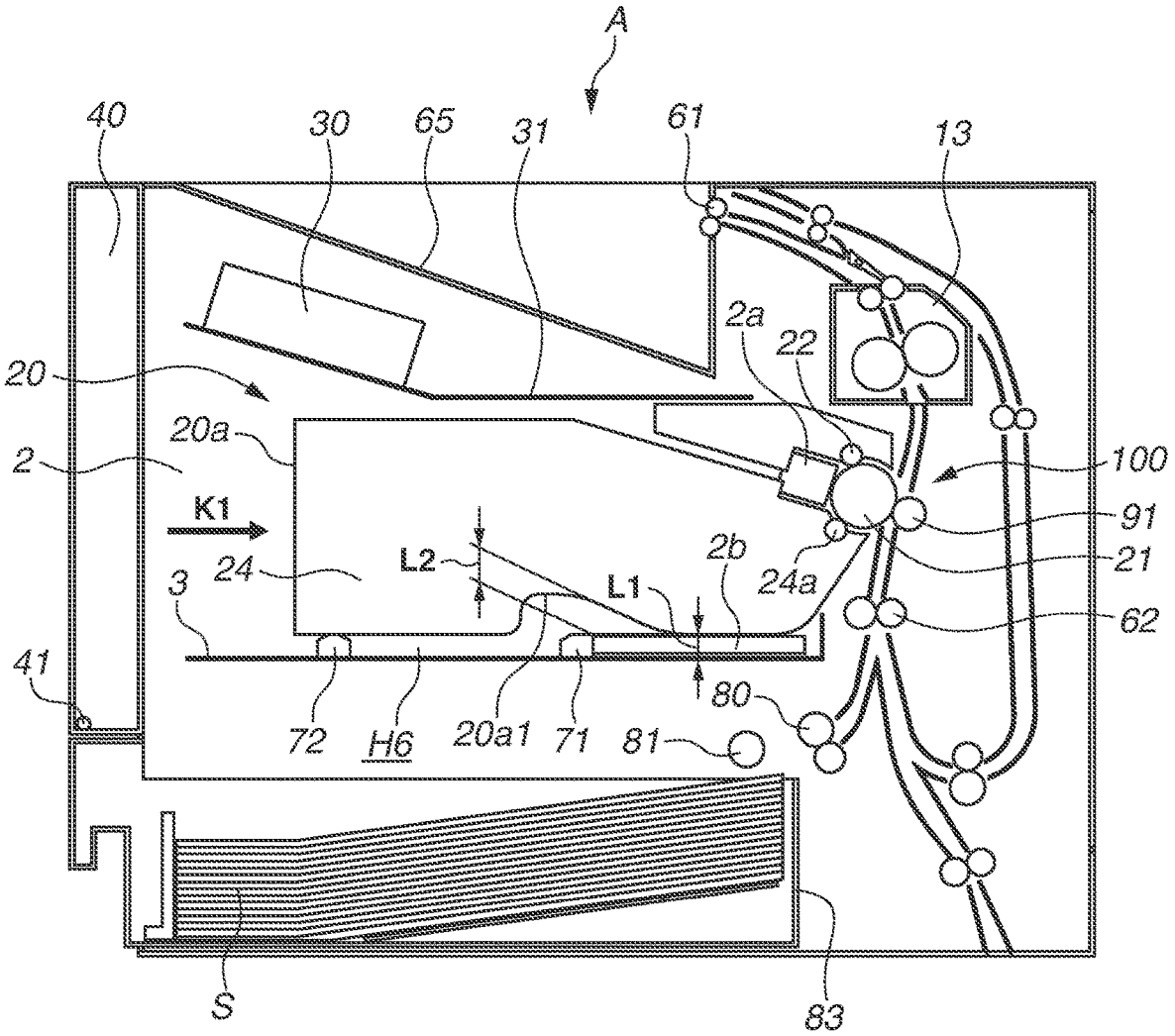
FIG. 10 is a schematic cross-sectional diagram illustrating the image forming apparatus.

FIGS. 9 and 10 are schematic cross-sectional diagrams illustrating the image forming apparatus A according to the present exemplary embodiment. FIG. 9 illustrates the image forming apparatus A with the process cartridge 10 mounted therein. FIG. 10 illustrates the image forming apparatus A with the process cartridge 20 mounted therein. As illustrated in FIGS. 9 and 10, according to the present exemplary embodiment, the image forming apparatus A is configured to include elastic members 71 and 72 made of elastic bodies, such as molds and rubber materials, on the central frame 3 (the support member) instead of the duct unit 50, in comparison with the configuration according to the first exemplary embodiment. The elastic member 72 (the second contact member) is supported on the central frame 3 at a position upstream with respect to the elastic member 71 (the first contact member) in the direction in which the process cartridges 10 and 20 are inserted toward the not-illustrated mounting unit (the direction indicated by the arrow K1 illustrated in FIGS. 9 and 10). Further, a cutout portion 20*a*1 is formed at the lower end portion of the housing 20*a* of the process cartridge 20. The other configuration is similar to the first exemplary embodiment.

As illustrated in FIG. 9, the process cartridge 10 is mounted onto the not-illustrated mounting unit by being inserted toward the not-illustrated mounting unit in the direction indicated by the arrow K1 via the not-illustrated opening portion appeared by the movement of the front cover 40 from the closed position to the opened position. When the process cartridge 10 is mounted on the not-illustrated mounting unit, the lower end portion of the housing 10*a* of the process cartridge 10 is in contact with the elastic member 71 while neither facing nor being in contact with the elastic member 72. As a result, a space H5, which is surrounded by the lower end portion of the housing 10*a* of the process cartridge 10, the central frame 3, and the elastic member 71, is formed below the housing 10*a* of the process cartridge 10.

As described above, while the image forming operation is performed by the image forming apparatus A, the fan 56 is in operation and the air outside the image forming apparatus A is introduced into the duct 57 with the air current generated by the fan 56. Then, a part of the air introduced into the duct 57 passes through the through-hole 2*b* and is supplied to the space H5 below the process cartridge 10. In other words, the duct 57 guides the air introduced from outside to inside the image forming apparatus A to the space H5.

The air supplied to the space H5 is blocked by the lower end portion of the housing 10*a* of the process cartridge 10, the central frame 3, and the elastic member 71, and flows in the space H5 in the longitudinal direction of the process cartridge 10. More specifically, the air flowing in the space H5 stays in the space H5 without flowing into the space on the front cover 40 side with respect to the process cartridge 10 by being blocked by the elastic member 71. In other words, the lower end portion of the housing 10*a* of the process cartridge 10, the central frame 3, and the elastic member 71 each function as the wall of the duct to define the air flow path. The process cartridge 10 is air-cooled across the longitudinal direction with the air flowing in the space H5 in this manner. After air-cooling the process cartridge 10, the air passes through the through-hole (not illustrated) formed on the right-side plate (not illustrated), and is exhausted to outside the image forming apparatus A via the exhaust port (not illustrated) formed on the right-side surface exterior of the image forming apparatus A.

Further, as illustrated in FIG. 10, the process cartridge 20 is mounted onto the not-illustrated mounting unit by being inserted toward the not-illustrated mounting unit in the direction indicated by the arrow K1 via the not-illustrated opening portion appeared by the movement of the front cover 40 from the closed position to the opened position. When the process cartridge 20 is mounted on the not-illustrated mounting unit, the lower end portion of the housing 20*a* of the process cartridge 20 is in contact with the elastic member 72 without being in contact the elastic member 71 although facing the elastic member 71. The housing 20*a* of the process cartridge 20 is not contact with the elastic member 71 because the cutout portion 20*a*1 is at the position of the elastic member 71 when the process cartridge 20 is mounted on the not-illustrated mounting unit. As a result, a space H6, which is surrounded by the lower end portion of the housing 20*a* of the process cartridge 20, the central frame 3, and the elastic member 72, is formed below the housing 20*a* of the process cartridge 20.

As described above, while the image forming operation is performed by the image forming apparatus A, the fan 56 is in operation and the air outside the image forming apparatus A is introduced into the duct 57 with the air current generated by the fan 56. Then, a part of the air introduced into the duct 57 passes through the through-hole 2*b* and is supplied to the space H6 below the process cartridge 20. In other words, the duct 57 guides the air introduced from outside to inside the image forming apparatus A to the space H6.

The air supplied to the space H6 is blocked by the lower end portion of the housing 20*a* of the process cartridge 20, the central frame 3, and the elastic member 72, and flows in the space H6 in the longitudinal direction of the process cartridge 20. More specifically, the air flowing in the space H6 stays in the space H6 without flowing into the space on the front cover 40 side with respect to the process cartridge 20 by being blocked by the elastic member 72. In other words, the lower end portion of the housing 20*a* of the process cartridge 20, the central frame 3, and the elastic member 72 each function as the wall of the duct to define the air flow path. The image forming apparatus A is configured in such a manner that a distance L1 between the cutout portion 20*a*1 of the housing 20*a* and the elastic member 71 is longer than a distance L2 between portions of the housing 20*a* other than the cutout portion 20*a*1 and the central frame 3 with respect to the direction perpendicular to the direction indicated by the arrow K1. This configuration facilitates the spread of the air throughout the entire space H6. The process cartridge 20 is air-cooled across the longitudinal direction thereof with the air flowing in the space H6 in this manner. After air-cooling the process cartridge 20, the air passes through the through-hole (not illustrated) formed on the right-side plate (not illustrated), and is exhausted to outside the image forming apparatus A via the exhaust port (not illustrated) formed on the right-side surface exterior of the image forming apparatus A.

In the above-described manner, in the image forming apparatus A according to the present exemplary embodiment, the air flow path for air-cooling the process cartridge 10 is defined using the lower end portion of the housing 10*a* of the process cartridge 10, the central frame 3, and the elastic member 71. The air flow path for air-cooling the process cartridge 20 is defined using the lower end portion of the housing 20*a* of the process cartridge 20, the central frame 3, and the elastic member 72. Due to such a configuration, the image forming apparatus A, which is configured to allow the process cartridges 10 and 20 in the plurality of sizes to be selectively mounted therein, can efficiently cool the mounted process cartridges 10 and 20. Therefore, the image forming apparatus A can reduce or suppress the increases in the temperatures of the process cartridges 10 and 20, whereby the toner contained in the process cartridges 10 and 20 can be prevented from being melted.

The first exemplary embodiment and the second exemplary embodiment have been described regarding the configuration using the contact units 52 and 53 or the elastic members 71 and 72 made of elastic bodies as the members that define the flow paths of the air by being in contact with the housings 10*a* and 20*a* of the process cartridges 10 and 20, respectively. However, the contact units 52 and 53 and the elastic members 71 and 72 do not necessarily have to be elastic bodies as long as they are configured to be able to define the flow paths of the air by being in contact with the housings 10*a* and 20*a* of the process cartridges 10 and 20. However, the configuration using the contact units 52 and 53 or the elastic members 71 and 72 made of elastic bodies is more desirable to allow the process cartridges 10 and 20 and the contact units 52 and 53 and the elastic members 71 and 72 to closely contact each other to prevent an air leak therebetween.

Next, a third exemplary embodiment of the image forming apparatus according to the present disclosure will be described with reference to the drawings. The third exemplary embodiment will be described, assigning the same reference numerals and omitting the descriptions with respect to portions whose redundant descriptions overlap the first exemplary embodiment or the second exemplary embodiment.

Figure 11A:
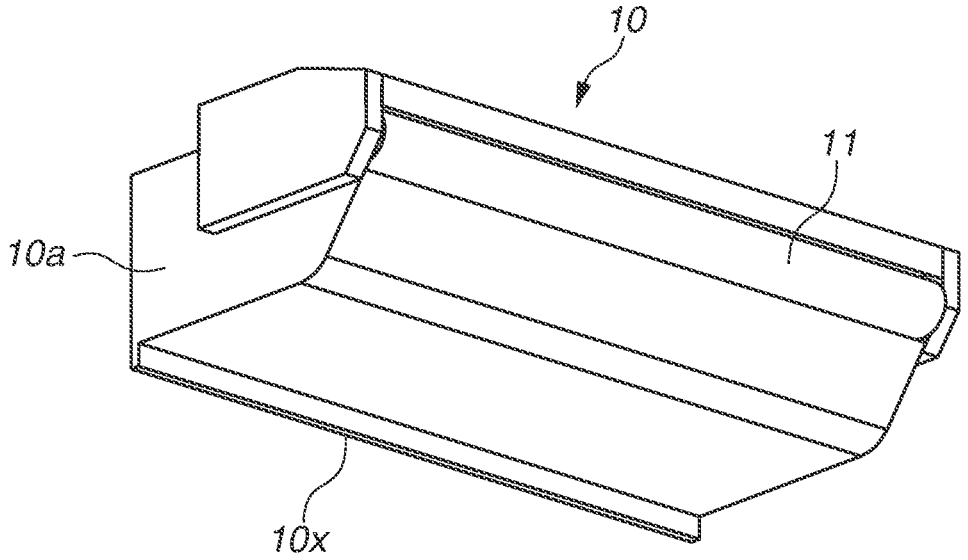
FIGS. 11A and 11B are perspective diagrams illustrating the process cartridges.
Figure 11B:
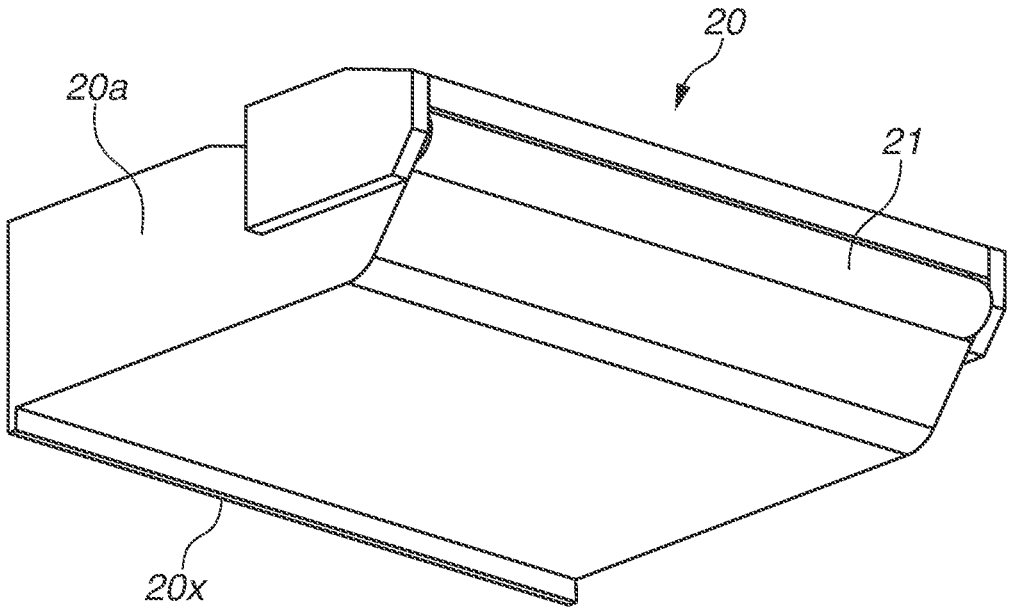
Figure 12:
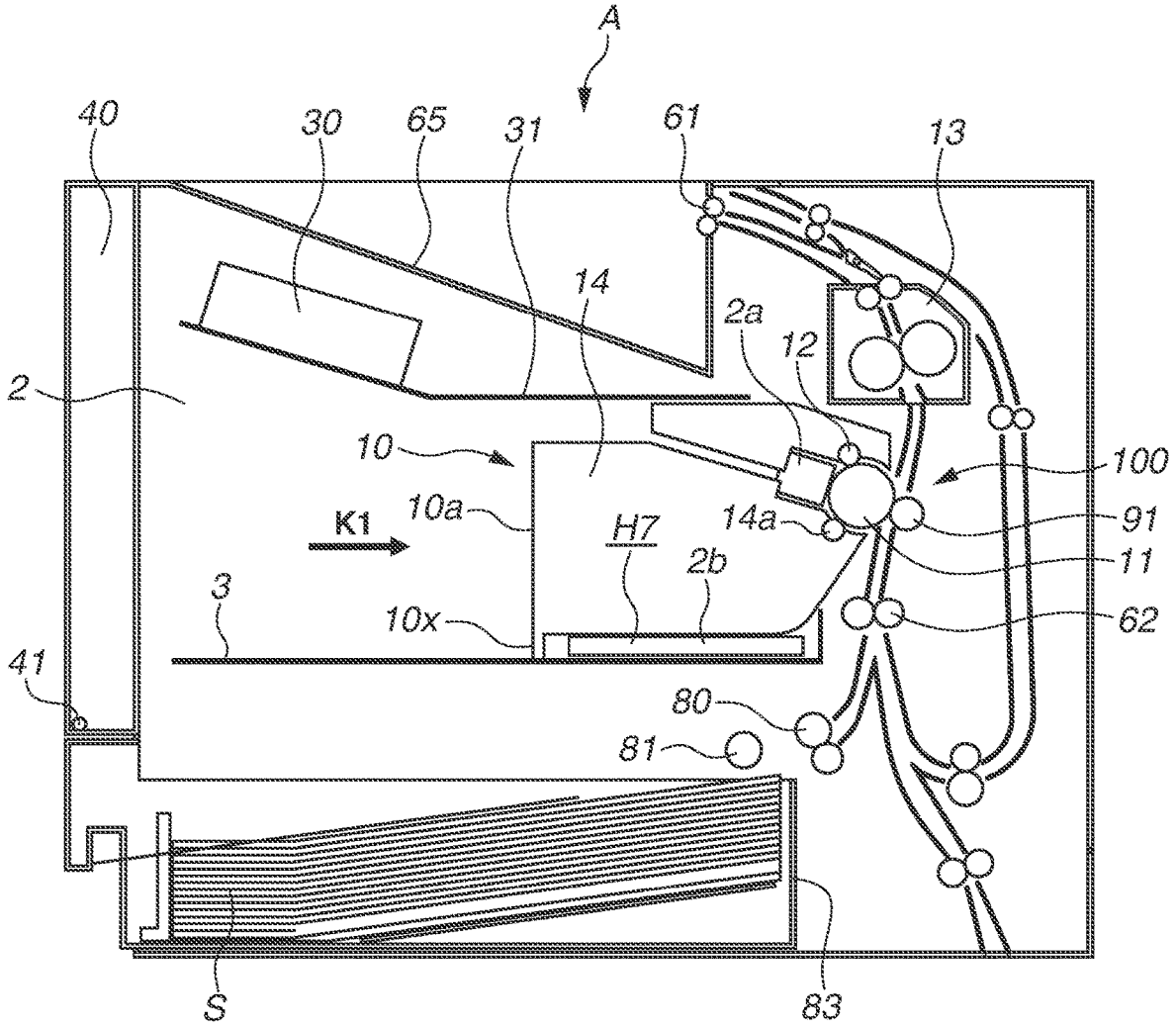
FIG. 12 is a schematic cross-sectional diagram illustrating the image forming apparatus.
Figure 13:
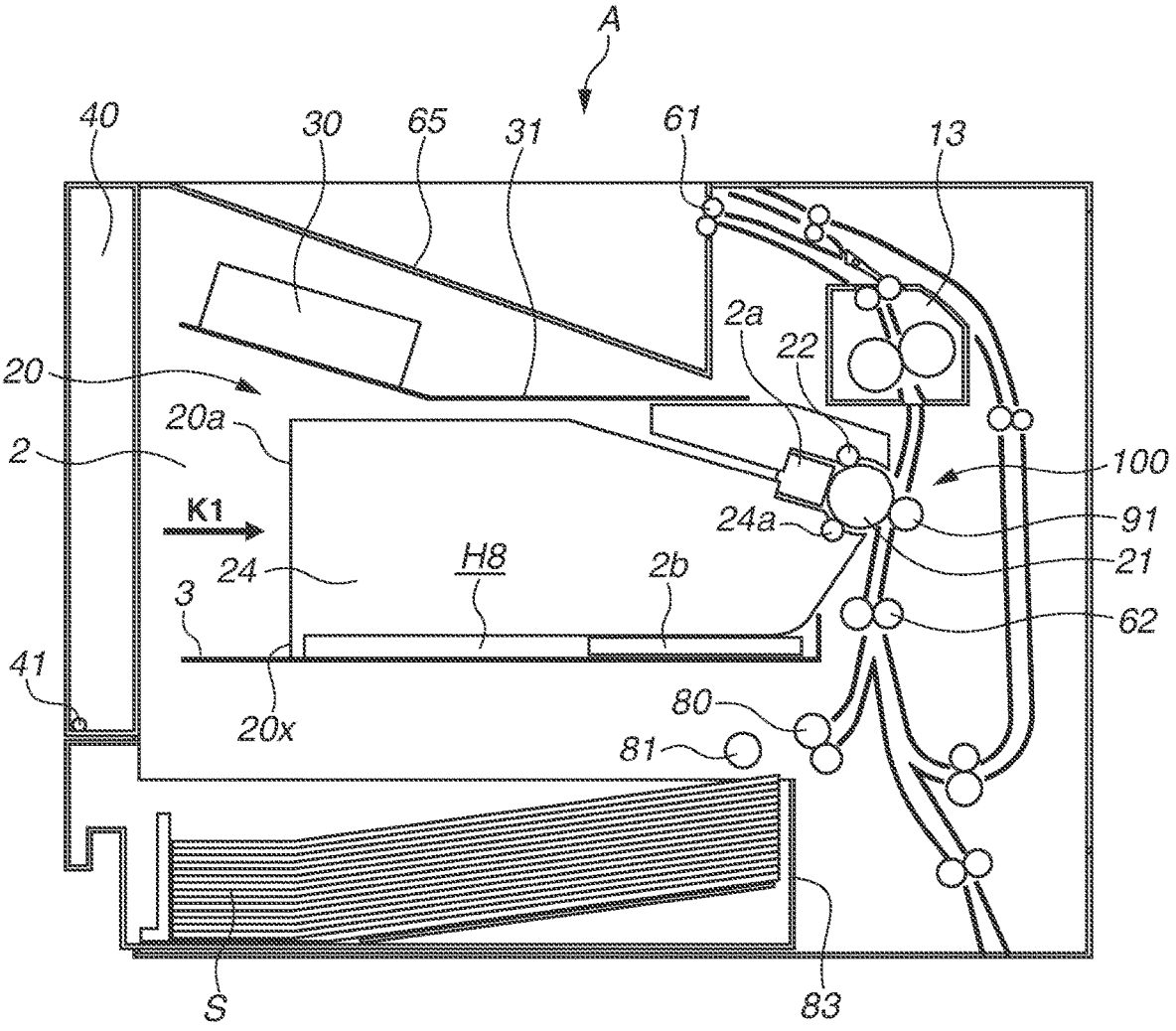
FIG. 13 is a schematic cross-sectional diagram illustrating the image forming apparatus.

FIGS. 11A and 11B are perspective diagrams illustrating the process cartridge 10 and the process cartridge 20 according to the present exemplary embodiment, respectively. FIGS. 12 and 13 are schematic cross-sectional diagrams illustrating the image forming apparatus A according to the present exemplary embodiment. FIG. 12 illustrates the image forming apparatus A with the process cartridge 10 mounted therein. FIG. 13 illustrates the image forming apparatus A with the process cartridge 20 mounted therein.

As illustrated in FIGS. 11A and 11B, the configurations of the process cartridges 10 and 20 according to the present exemplary embodiment are different from the configurations according to the first exemplary embodiment in terms of the shapes of the housings 10*a* and 20*a*. More specifically, a rib 10*x* (a first protrusion portion) is formed at the end portion that is the lower end portion of the housing 10*a* of the process cartridge 10 and is located on the upstream side in the direction in which the process cartridge 10 is inserted toward the not-illustrated mounting unit. The rib 10*x* protrudes to extend perpendicularly to (intersect with) the insertion direction. Further, a rib 20*x* (a second protrusion portion) is formed at the end portion that is the lower end portion of the housing 20*a* of the process cartridge 20 and is located on the upstream side in the direction in which the process cartridge 20 is inserted toward the not-illustrated mounting unit. The rib 20*x* protrudes to extend perpendicularly to (intersect with) the insertion direction. The other configuration is similar to the first exemplary embodiment.

Further, as illustrated in FIGS. 12 and 13, the configuration of the image forming apparatus A according to the present exemplary embodiment except for the process cartridges 10 and 20 corresponds from the configuration according to the first exemplary embodiment but without the duct unit 50. The other configuration is similar to the first exemplary embodiment.

As illustrated in FIG. 12, the process cartridge 10 is mounted onto the not-illustrated mounting unit by being inserted toward the not-illustrated mounting unit in the direction indicated by the arrow K1 via the not-illustrated opening portion appeared by the movement of the front cover 40 from the closed position to the opened position. When the process cartridge 10 is mounted on the not-illustrated mounting unit, the rib 10*x* of the housing 10*a* of the process cartridge 10 is in contact with the central frame 3 (the contact member). As a result, a space H7, which is surrounded by the housing 10*a* of the process cartridge 10 including the rib 10*x* and the central frame 3, is formed below the housing 10*a* of the process cartridge 10. In other words, the space H7, which is surrounded by the rib 10*x* and the portion adjacent to the rib 10*x* in the direction indicated by the arrow K1 in the housing 10*a* of the process cartridge 10 and the central frame 3, is formed below the housing 10*a* of the process cartridge 10.

As described above, while the image forming operation is performed by the image forming apparatus A, the fan 56 is in operation and the air outside the image forming apparatus A is introduced into the duct 57 with the air current generated by the fan 56. Then, a part of the air introduced into the duct 57 passes through the through-hole 2*b* and is supplied to the space H7 below the process cartridge 10. In other words, the duct 57 guides the air introduced from outside to inside the image forming apparatus A to the space H7.

The air supplied to the space H7 is blocked by the housing 10*a* of the process cartridge 10 including the rib 10*x* and the central frame 3, and flows in the space H7 in the longitudinal direction of the process cartridge 10. More specifically, the air flowing in the space H7 stays in the space H7 without flowing into the space on the front cover 40 side with respect to the process cartridge 10 by being blocked by the rib 10*x*. In other words, the housing 10*a* of the process cartridge 10 including the rib 10*x* and the central frame 3 each function as the wall of the duct to define the air flow path. The process cartridge 10 is air-cooled across the longitudinal direction thereof with the air flowing in the space H7 in this manner. After air-cooling the process cartridge 10, the air passes through the through-hole (not illustrated) formed on the right-side plate (not illustrated), and is exhausted to outside the image forming apparatus A via the exhaust port (not illustrated) formed on the right-side surface exterior of the image forming apparatus A.

Further, as illustrated in FIG. 13, the process cartridge 20 is mounted onto the not-illustrated mounting unit by being inserted toward the not-illustrated mounting unit in the direction indicated by the arrow K1 via the not-illustrated opening portion formed by the movement of the front cover 40 from the closed position to the opened position. When the process cartridge 20 is mounted on the not-illustrated mounting unit, the rib 20*x* of the housing 20*a* of the process cartridge 20 is in contact with the central frame 3. As a result, a space H8, which is surrounded by the housing 20*a* of the process cartridge 20 including the rib 20*x* and the central frame 3, is formed below the housing 20*a* of the process cartridge 20. In other words, the space H8, which is surrounded by the rib 20*x* and the portion adjacent to the rib 20*x* in the direction indicated by the arrow K1 in the housing 20*a* of the process cartridge 20 and the central frame 3, is formed below the housing 20*a* of the process cartridge 20.

As described above, while the image forming operation is performed by the image forming apparatus A, the fan 56 is in operation and the air outside the image forming apparatus A is introduced into the duct 57 with the air current generated by the fan 56. Then, a part of the air introduced into the duct 57 passes through the through-hole 2*b* and is supplied to the space H8 below the process cartridge 20. In other words, the duct 57 guides the air introduced from outside to inside the image forming apparatus A to the space H8.

The air supplied to the space H8 is blocked by the housing 20*a* of the process cartridge 20 including the rib 20*x* and the central frame 3, and flows in the space H8 in the longitudinal direction of the process cartridge 20. More specifically, the air flowing in the space H8 stays in the space H8 without flowing into the space on the front cover 40 side with respect to the process cartridge 20 by being blocked by the rib 20*x*. In other words, the housing 20*a* of the process cartridge 20 including the rib 20*x* and the central frame 3 each function as the wall of the duct to define the air flow path. The process cartridge 20 is air-cooled across the longitudinal direction thereof with the air flowing in the space H8 in this manner. After air-cooling the process cartridge 20, the air passes through the through-hole (not illustrated) formed on the right-side plate (not illustrated), and is exhausted to outside the image forming apparatus A via the exhaust port (not illustrated) formed on the right-side surface exterior of the image forming apparatus A.

In the above-described manner, in the image forming apparatus A according to the present exemplary embodiment, the air flow path for air-cooling the process cartridge 10 is defined using the housing 10*a* of the process cartridge 10 including the rib 10*x* and the central frame 3. The air flow path for air-cooling the process cartridge 20 is defined using the housing 20*a* of the process cartridge 20 including the rib 20*x* and the central frame 3. Due to such a configuration, the image forming apparatus A, which is configured to allow the process cartridges 10 and 20 in the plurality of sizes to be selectively mounted therein, can efficiently cool the mounted process cartridges 10 and 20. Therefore, the image forming apparatus A can reduce or suppress the increases in the temperatures of the process cartridges 10 and 20, whereby the toner contained in the process cartridges 10 and 20 can be prevented from being melted.

In the first to third exemplary embodiments, the present disclosure has been described citing the image forming apparatus A of a monochrome-type including one mounting unit and configured to allow any one of the process cartridge 10 and the process cartridge 20 to be mounted on this mounting unit as an example. However, the present disclosure is not limited thereto. More specifically, similar advantageous effects can also be acquired even by applying the configuration of the present disclosure to an image forming apparatus, capable of forming a full-color image, including a plurality of mounting units and configured to allow the process cartridge 10 or the process cartridge 20 to be selectively mounted on each of the plurality of mounting units.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-113769, filed Jul. 1, 2020, which is hereby incorporated by reference herein in its entirety.

What is claimed is:

1. An image forming apparatus configured to allow a first process cartridge and a second process cartridge to be selectively mounted therein, the first process cartridge including a first photosensitive member and a first development unit configured to supply a developer to the first photosensitive member, the second process cartridge including a second photosensitive member and a second development unit configured to supply a developer to the second photosensitive member, the second process cartridge having a housing larger in size than a housing of the first process cartridge, the image forming apparatus comprising:

a first contact member configured to come into contact with the housing of the first process cartridge when the first process cartridge is mounted;

a second contact member configured to come into contact with the housing of the second process cartridge when the second process cartridge is mounted;

a support member supporting the first contact member and the second contact member;

an intake unit configured to introduce air from outside to inside the image forming apparatus; and an exhaust unit configured to exhaust the air introduced to inside the image forming apparatus via the intake unit to outside the image forming apparatus, wherein, when the first process cartridge is mounted, the air introduced to inside the image forming apparatus via the intake unit flows in a space surrounded by the housing of the first process cartridge, the first contact member, and the support member, and is exhausted via the exhaust unit, and wherein, when the second process cartridge is mounted, the air introduced to inside the image forming apparatus via the intake unit flows in a space surrounded by the housing of the second process cartridge, the second contact member, and the support member, and is exhausted via the exhaust unit.

2. The image forming apparatus according to claim 1, wherein the support member is pivotally supported, and wherein the image forming apparatus includes a biasing member configured to bias the support member, to bias the first contact member against the housing of the first process cartridge or to bias the second contact member against the housing of the second process cartridge.

3. The image forming apparatus according to claim 1, wherein the first contact member and the second contact member are elastic bodies.

4. The image forming apparatus according to claim 1, wherein a duct is connected to the intake unit, wherein a fan is provided inside the duct, wherein, when the first process cartridge is mounted, the air introduced to inside the image forming apparatus via the intake unit is guided by the duct to the space surrounded by the housing of the first process cartridge, the first contact member, and the support member, and wherein, when the second process cartridge is mounted, the air introduced to inside the image forming apparatus via the intake unit is guided by the duct to the space surrounded by the housing of the second process cartridge, the second contact member, and the support member.

5. The image forming apparatus according to claim 1, wherein a fan is actuated when the image forming apparatus performs an image forming operation, and is stopped when the image forming apparatus does not perform the image forming operation.

6. The image forming apparatus according to claim 1, wherein, when the second process cartridge is mounted, the first contact member does not come into contact with the housing of the second process cartridge while facing the housing of the second process cartridge, and wherein, when the first process cartridge is mounted, the second contact member neither faces nor comes into contact with the housing of the first process cartridge.

7. An image forming apparatus comprising:

a process cartridge including a photosensitive roller and a housing covering the photosensitive roller;

a frame provided at a position facing the process cartridge;

a contact member configured to come into contact with the housing of the process cartridge when the process cartridge is mounted;

a support member supporting the contact member;

a spring provided on the frame to urge the support member towards the process cartridge; and a through-hole located on a side of the image forming apparatus to draw air into the image forming apparatus, wherein, when the process cartridge is mounted, the air introduced to inside the image forming apparatus via the through-hole flows in a space surrounded by the housing of the process cartridge, the contact member, and the support member, and wherein, the contact member is located upstream of the through-hole in a mounting direction of the cartridge.

* * * * *